United States Patent [19]

Schulz

[11] Patent Number: 4,610,116

[45] Date of Patent: Sep. 9, 1986

[54] SKYLIGHT ASSEMBLY

[75] Inventor: Kenneth Schulz, New York, N.Y.

[73] Assignee: Soletude, Inc., New York, N.Y.

[21] Appl. No.: 577,681

[22] Filed: Feb. 7, 1984

[51] Int. Cl.[4] ..... E04D 13/03

[52] U.S. Cl. ..... 52/204; 49/337; 49/371; 49/325; 52/58; 52/72; 160/94

[58] Field of Search ..... 52/72, 200, 18, 204, 52/58; 160/93, 94, 98–100; 49/347, 337, 325, 371; 47/17; 98/42.16, 42.12, 88.1, 42.22, 99.4

[56] References Cited

U.S. PATENT DOCUMENTS

| | | | |
|---|---|---|---|
| 159,346 | 2/1875 | Musgrove | 47/17 |
| 188,689 | 3/1877 | Specht et al. | 52/200 |
| 391,442 | 10/1888 | Welburn | 52/90 |
| 968,480 | 8/1910 | Just et al. | 52/72 |
| 1,195,643 | 8/1916 | Baumgartl | 52/503 |
| 1,211,053 | 1/1917 | Bernard | 52/72 |
| 1,427,175 | 8/1922 | Syvan | 49/371 |
| 1,498,106 | 4/1921 | Montgomery | 160/98 |
| 1,499,397 | 7/1924 | Myers | 52/529 |
| 1,959,941 | 5/1934 | Wiley | 49/371 |
| 2,046,601 | 7/1936 | Atkinson | 47/17 |
| 2,153,508 | 4/1939 | Marchbank | 98/99.4 |
| 2,203,314 | 5/1939 | Towsky | 52/18 |
| 2,311,413 | 2/1943 | Persson | 160/94 |
| 2,354,408 | 7/1944 | Sherrill | 52/18 |
| 2,384,719 | 9/1945 | Anderson | 52/18 |
| 2,535,933 | 12/1950 | Kubatzky | 98/88.1 |
| 2,653,553 | 9/1953 | Jacobs | 47/17 |
| 2,832,590 | 4/1958 | Youngberg | 49/325 |
| 3,638,358 | 2/1972 | Mason | 49/325 |
| 4,038,791 | 8/1977 | Atkinson | 52/73 |
| 4,173,854 | 11/1979 | Wallerstein | 52/200 |

FOREIGN PATENT DOCUMENTS

| | | | |
|---|---|---|---|
| 1143763 | 10/1957 | France | 52/18 |
| 71590 | 6/1937 | Norway | 49/325 |
| 119111 | 2/1970 | Norway | 52/18 |
| 364349 | 10/1962 | Switzerland | 52/18 |
| 308644 | 3/1929 | United Kingdom | 52/200 |
| 801367 | 9/1958 | United Kingdom | 52/18 |

*Primary Examiner*—John E. Murtagh

*Attorney, Agent, or Firm*—Alan H. Levine

[57] ABSTRACT

A skylight assembly including a frame for securement within an opening in a pitched roof, and a window supported within the frame. Water flowing down the roof is directed, such as by a specially shaped flashing, to flow on to the window, and water flowing down the window is directed, such as by another specially shaped flashing, to flow on to the roof below the skylight frame. No part of the window projects outwardly beyond the outer edge of the skylight frame, and the window pivots inwardly to open the slylight. A window screen automatically advances to cover the opening when the window is opened, and shades of different types can be pulled across the window.

14 Claims, 7 Drawing Figures

SKYLIGHT ASSEMBLY

This invention relates to skylights for buildings, and more particularly to a skylight assembly for use in the pitched roof of a building.

A major problem associated with conventional roof skylights involves leakage of rainwater around the skylight into the interior of the building. Most skylights rely on gaskets or seals to prevent such leakage. However, unless seals are fitted into place accurately during their initial installation they fail to perform as intended and thereby permit undesirable leaks. Furthermore, seals tend to dry out or deform with time, thus reducing their ability to maintain a leak-free interconnection between the skylight assembly and the roof structure within which the skylight is installed.

Another problem, at least from an esthetic point of view, presented by most conventional skylights is that some part of the skylight assembly, usually the curb upon which the skylight unit is mounted, projects outwardly from the plane of the roof in which it is installed, thereby interrupting the roofline. Such outward bulging of the skylight is generally thought desirable to keep water from flowing on to the skylight window and to avoid any part of the skylight creating a depression in the roof within which water can accumulate.

It is an object of the present invention to provide a skylight assembly for installation in a pitched roof which does not rely on seals or curbs to prevent water flowing down the roof from leaking past the skylight assembly into the interior of the building. According to the invention, water flowing down the roof is directed on to the window of the skylight which channels it toward a ramp or funnel-like element, the latter directing the water on to a portion of the roof below the skylight.

It is an additional object of the invention to provide such a skylight assembly wherein even when the skylight window is open it still serves to channel rainwater toward the ramp or funnel-like element.

It is another object of the invention to provide a skylight assembly which is contained entirely within the external contour of the roof whether open or closed, and hence does not at any time break the profile of the roofline.

It is a further object of the invention to provide such a skylight assembly including a window screen arrangement which is automatically extended when the skylight window is opened, to cover the opening, and which is automatically retracted when the window is closed.

It is still another object of the invention to provide a skylight assembly incorporating one or more shades, e.g., tinted sun block shades, opaque blackout shades, and thermal barrier shades, which can be optionally drawn across the skylight window.

It is yet a further object of the invention to provide such a skylight assembly which can be packaged as a ready-to-install unit with a prefinished interior, for mounting within a properly sized pre-cut opening in a roof.

Additional objects and features of the invention will be apparent from the following description, in which reference is made to the accompanying drawings. In the drawings.

Figure 1:
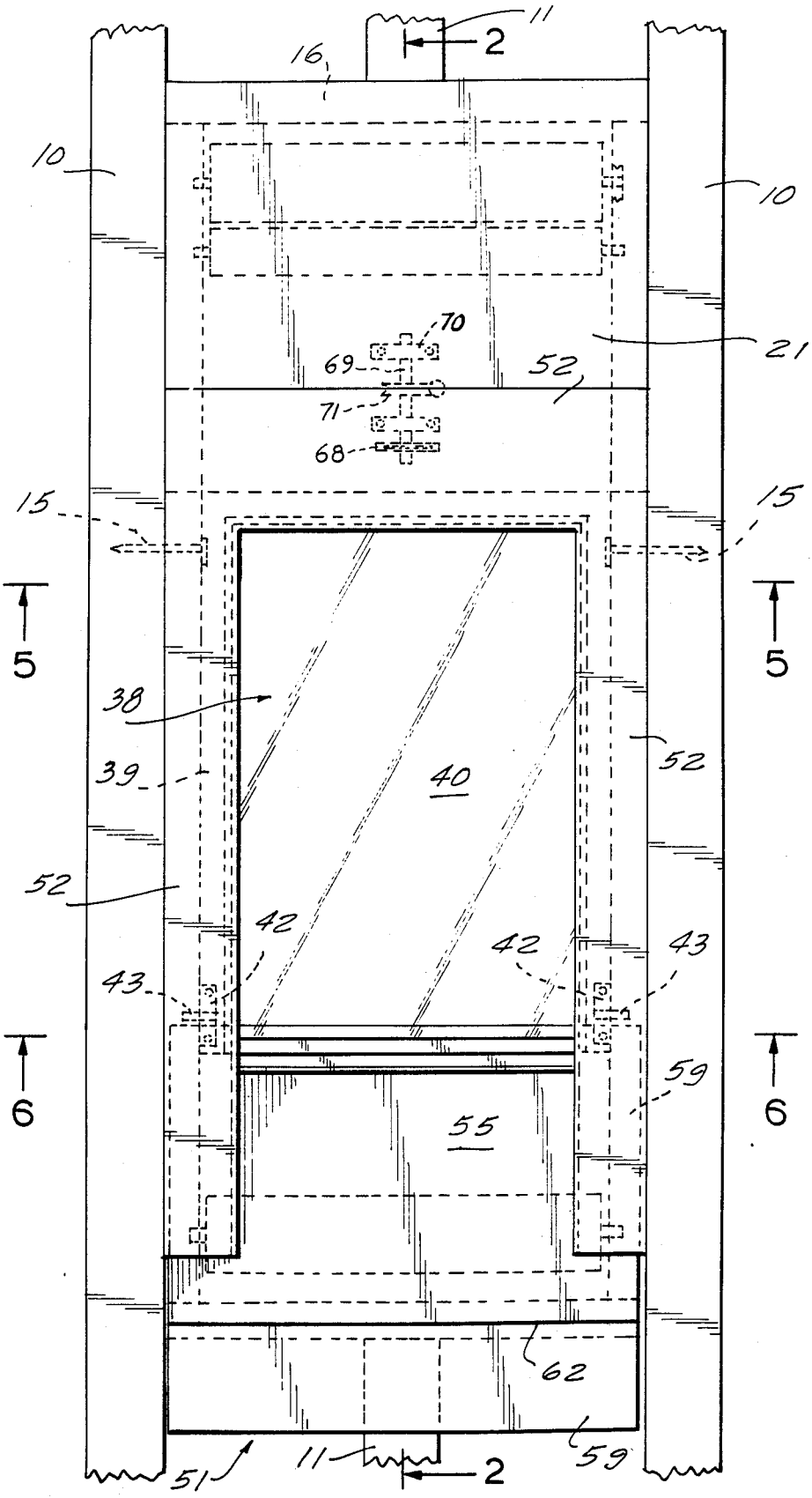
FIG. 1 is a face view of a skylight assembly according to the invention, installed in a pitched roof, taken along line 1—1 of FIG. 2, the roof shingles being removed for the sake of clarity.
Figure 5:
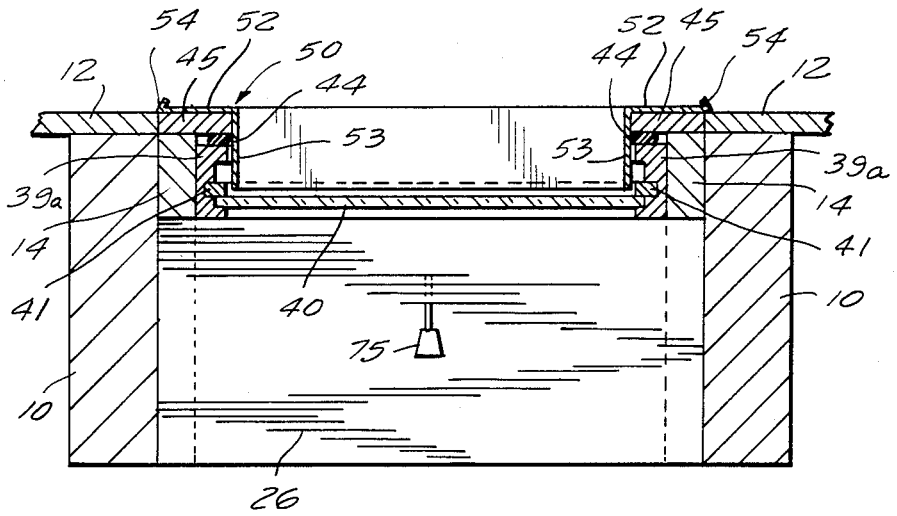
Figure 6:
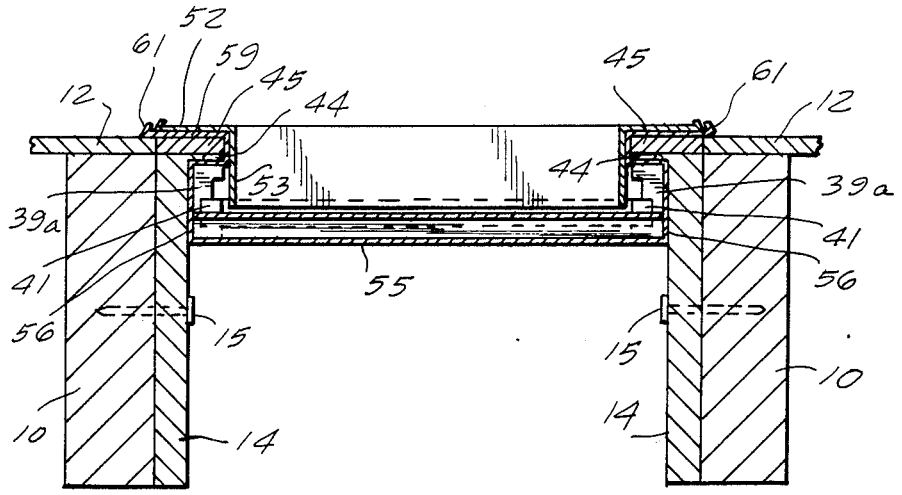
Figure 7:
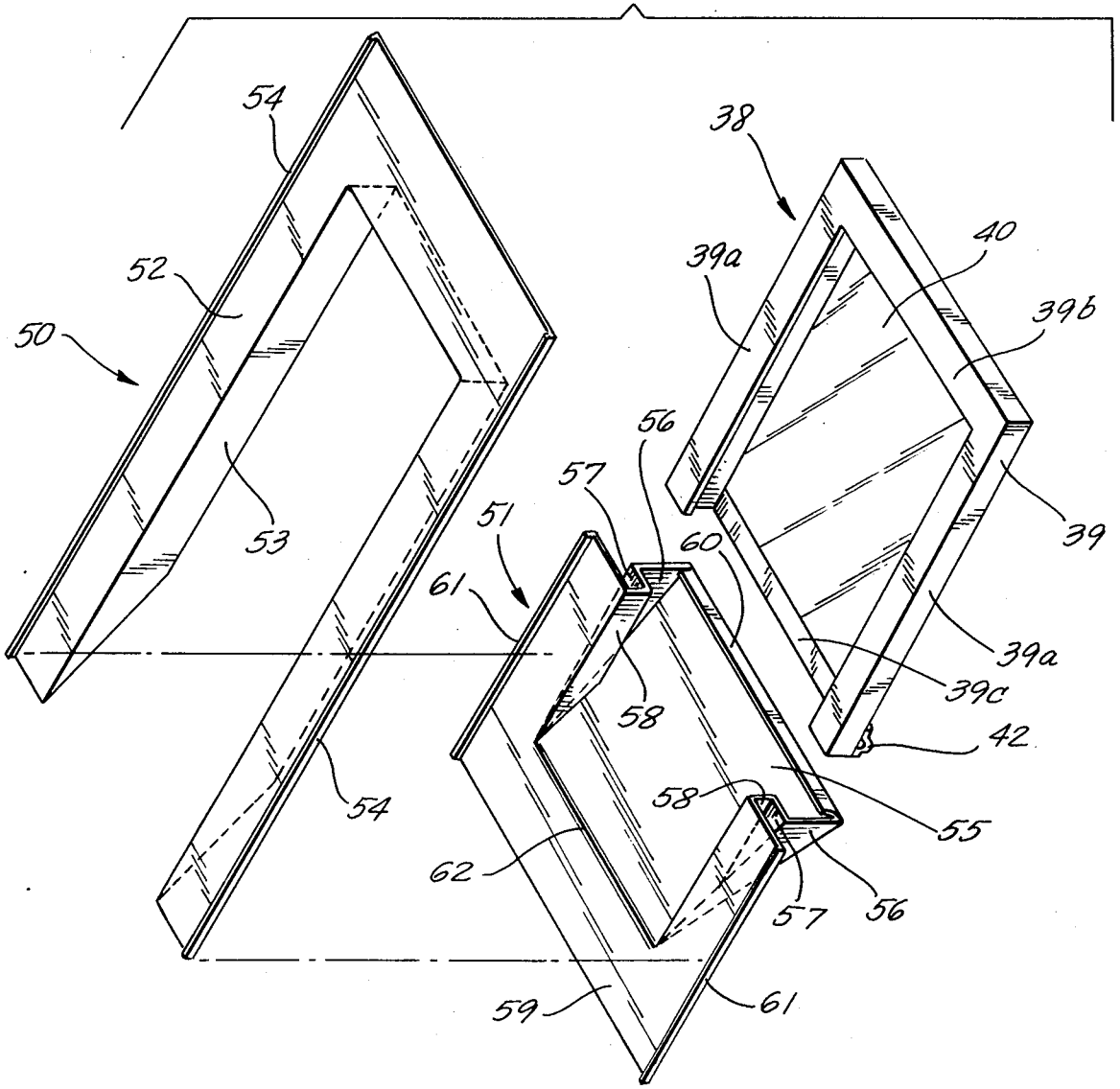

FIGS. 5 and 6 are cross-sectional views, taken perpendicular to the plane of the roof, along lines 5—5 and 6—6 of FIG. 1, respectively; and FIG. 7 is an exploded perspective view of two flashings and the window of the skylight assembly according to the invention.

Figure 2:
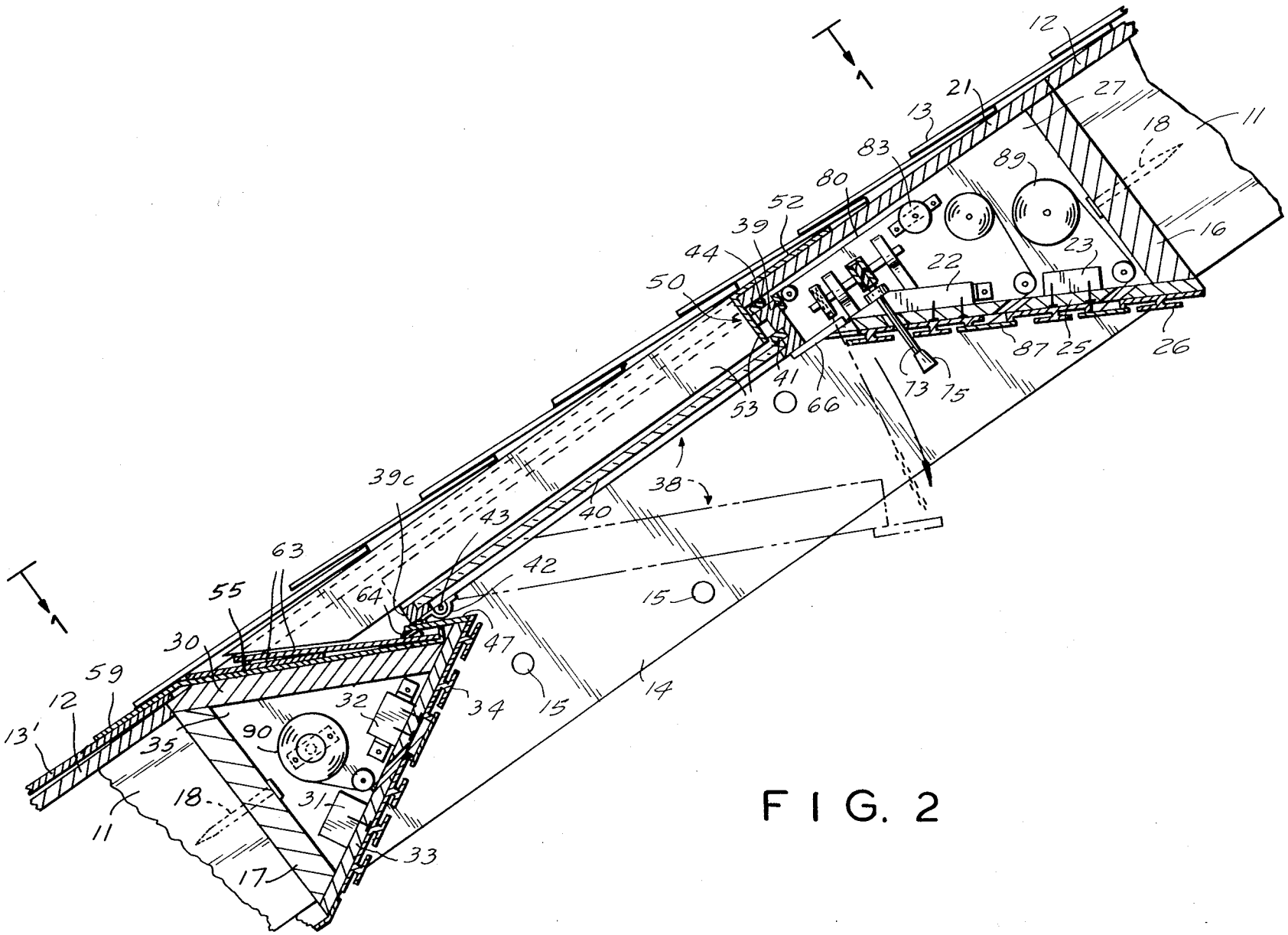
FIG. 2 is a vertical cross-sectional view taken along line 2—2 of FIG. 1.

A skylight assembly according to the invention is intended to be installed within a pre-cut rectangular opening in the pitched roof of a building. In FIGS. 1 and 2 the roof is illustrated as comprising parallel rafters 10 and 11, plywood or other type of board 12 secured to the outer edges of the rafters, and shingles 13 covering the outer face of the board 12. In making the opening in the roof, the shingles 13 have been cut through or removed, a rectangular hole cut in the board 12, and a section of rafter 11 removed.

The skylight assembly chosen to illustrate the present invention includes a rectangular frame having a size about equal to that of the opening provided in the roof, the frame fitting between rafters 10 and between the cut ends of rafter 11. The skylight frame includes two side members 14, an upper cross-member 16, and a lower cross member 17. The cross-members are fixed to the upper and lower ends, respectively, of side members 14. When the frame is installed, side members 14 are arranged against opposed faces of rafters 10 and fixed to those rafters, such as by nails 15 (see also FIG. 6). In addition, upper cross-member 16 and lower cross-member 17 are fixed to the upper and lower cut ends of the rafter 11, respectively, such as by nails 18. As indicated in FIG. 2, the outer edges of frame side members 14 and cross-members 16 and 17 are installed flush with the outer edges of rafters 10 and 11. (As used herein, the terms "inner" and "outer" refer to the interior and exterior of the building, the exterior being at the upper left in FIG. 2; the terms "upper" and "lower" refer to the direction of water flow down the inclined roof from an upper point at the right in FIG. 2 to a lower point at the left.)

A panel 21 (FIGS. 1–3), similar in thickness to the thickness of roof boards 12, overlies the outer edges of cross-member 16 and side members 14, at the upper end of the skylight frame, and is secured to the frame. Small beams 22 and 23 (FIGS. 2 and 3) extend between frame side members 14, inwardly of panel 21, and are secured at their ends to members 14, such as by angle brackets 24. An oblique panel 25 is secured to beams 22 and 23 and to the inner edge of cross-member 16, and a decorative grill-like facade 26 is carried by the inner face of panel 25, the panel and facade extending across the entire width of the skylight frame. Panel 21, panel 25, and cross-member 16 together define a chamber 27 within the upper part of the skylight frame, the chamber accommodating certain accessories which will be described hereinafter.

An inclined panel 30 (FIGS. 2 and 4), extending between frame side members 14, is fixed to the outer edge of cross-member 17 and at its ends to side members 14. While panel 30 is oriented more toward the horizontal than the skylight frame and the roof, it is still inclined downwardly from right to left in FIGS. 2 and 4. Small beams 31 and 32 extend between side members 14, inwardly of panel 30, and are secured at their ends to members 14, such as by angle brackets 24. An oblique panel 33 is secured to beams 31 and 32 and to the inner edge of cross-member 17, and a decorative grill-like facade 34 is carried by the inner face of panel 33, the panel and facade extending across the entire width of the skylight frame. Panel 30, panel 33, and cross-member 17 together define a chamber 35 within the lower part of the skylight frame, the chamber accommodating certain accessories which will be described hereinafter. It will be appreciated that the oblique panels 25 and 33, with their grill-like facades, give a decorative finished appearance to the interior of the skylight.

Arranged in the region between the side members 14 and generally between the oblique panels 25 and 33 is a skylight window 38 (FIGS. 1–4 and 7). The window includes a frame 39 within which the edges of a transparent or translucent window pane 40 are supported. The two sides 39*a* and the upper end 39*b* of frame 39 project outwardly beyond the plane of pane 40. A length of sealing material 41 provides a water tight connection between the pane 40 and each side 39*a* and upper end 39*b* of the frame. At its lower end 39*c*, window frame 39 is formed with its outer face flush with the outer face of pane 40.

Figure 4:
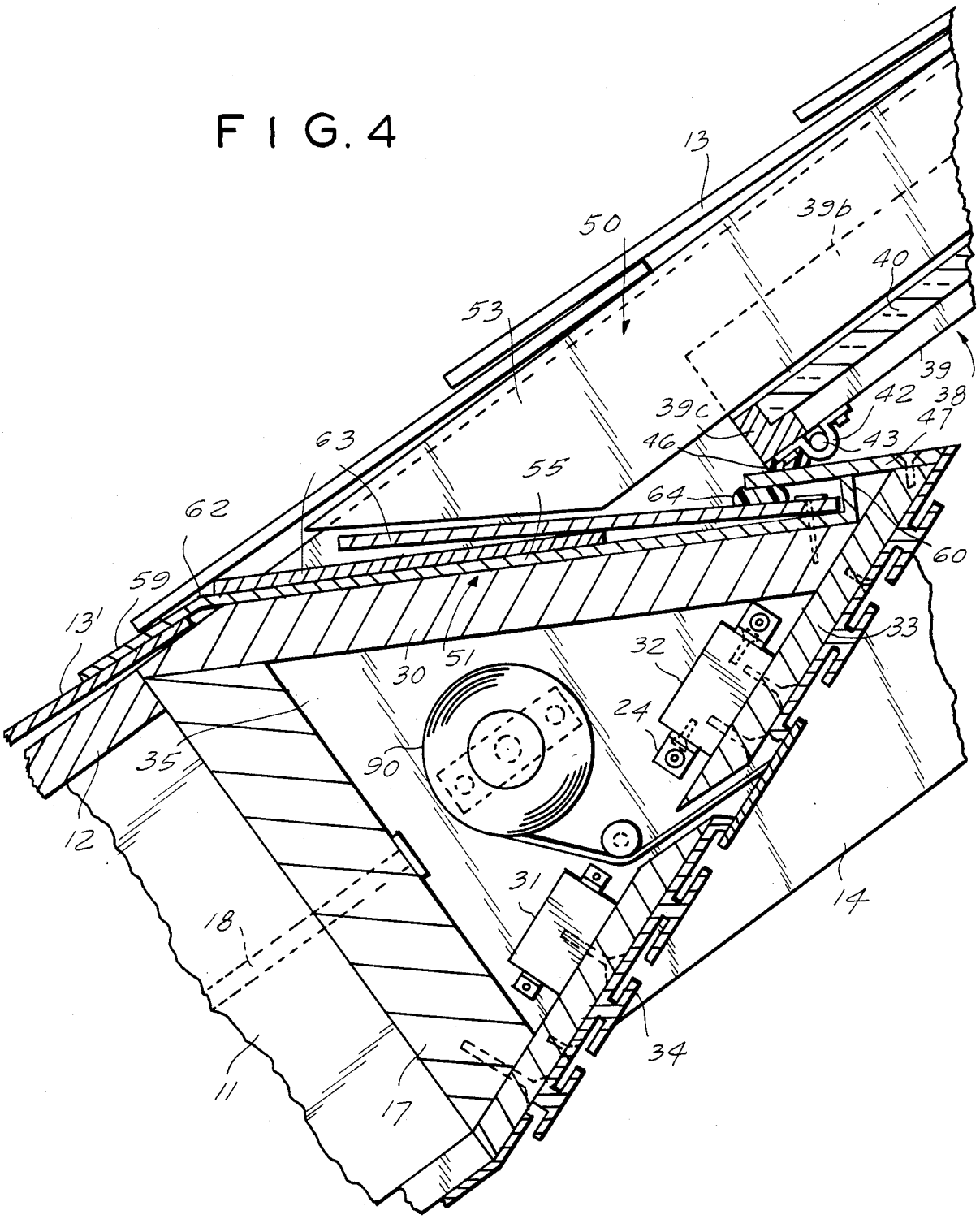

At each side of the window frame lower end 39*c*, the inner face has mounted on it a U-bracket 42 which serves as the journal for a pivot pin 43 projecting from one of the side members 14 (FIGS. 1, 2 and 4). In this way, window 38 is pivotally mounted between the side members for pivotal movement about an axis defined by the colinear axes of pins 43. Window 38 can swing from a closed position, shown in solid lines in FIG. 2, to an open position, shown in broken lines.

The outer faces of window frame parts 39*a* and 39*b* are furnished with a gasket 44 (FIGS. 2, 3, 5, and 6). When the window is closed, the portion of this gasket carried by frame part 39*b* presses against the inner face of panel 21 (FIG. 3), and the portions of this gasket carried by frame parts 39*a* press against the inner faces of narrow panels 45 (FIGS. 5 and 6) mounted on the outer faces of frame side members 14. Another gasket 46 (FIG. 4) is sandwiched between the lower end of the inner face of window frame part 39*c* and a narrow panel 47 mounted on the outer end of oblique panel 33. The primary purpose of gaskets 44 and 46 is to prevent loss of heat from the room having the skylight. These gaskets are not necessary to prevent water leakage.

The skylight assembly also includes two flashing members 50 and 51, best seen in FIG. 7. Members 50 and 51 are preferably fabricated of sheet metal, although other materials may also prove to be satisfactory. Flashing member 50 is generally U-shaped, and includes a planar portion 52 and an inwardly projecting portion 53 depending from the inside peripheral edge of portion 52. The lower ends of portion 53 are cut at an angle about equal to the angle between the pitch of the roof and panel 30 (see FIG. 4). Each side edge of planar portion 52 is bent upwardly to form a longitudinally extending lip 54.

Flashing member 51 includes a ramp portion 55 flanked by two outwardly projecting side walls 56. At their outer ends, side walls 56 are bent toward each other to form overhangs 57, the overhangs being bent outwardly to form short walls 58, and the short walls being bent away from each other to form a U-shaped planar portion 59. Ramp portion 55 forms an acute angle with planar portion 59, and merges into that portion at a bend line 62. In addition, side walls 56 taper toward each other in a downward direction, i.e., the direction of water flow down the roof, so that ramp 55 and side walls 56 form a funnel-like construction. At its upper end, ramp 55 is provided with an upstanding lip 60, and planer portion 59 is formed with a longitudinally extending upstanding lip 61 at each side.

Ramp portion 55 of flashing member 51 is secured to the outer face of inclined panel 30 (FIGS. 2 and 4), lip 60 being beneath and projecting outwardly toward narrow panel 47. The lower end of window 39, together with panel 47, are accommodated within the upper end of the funnel-like structure defined by ramp portion 55, side walls 56, and overhangs 57. The two sides of planar portion 59 extend over narrow panels 45 (FIG. 6), these panels being accommodated between planar portion 59 and overhangs 57 of flashing members 51.

Figure 3:
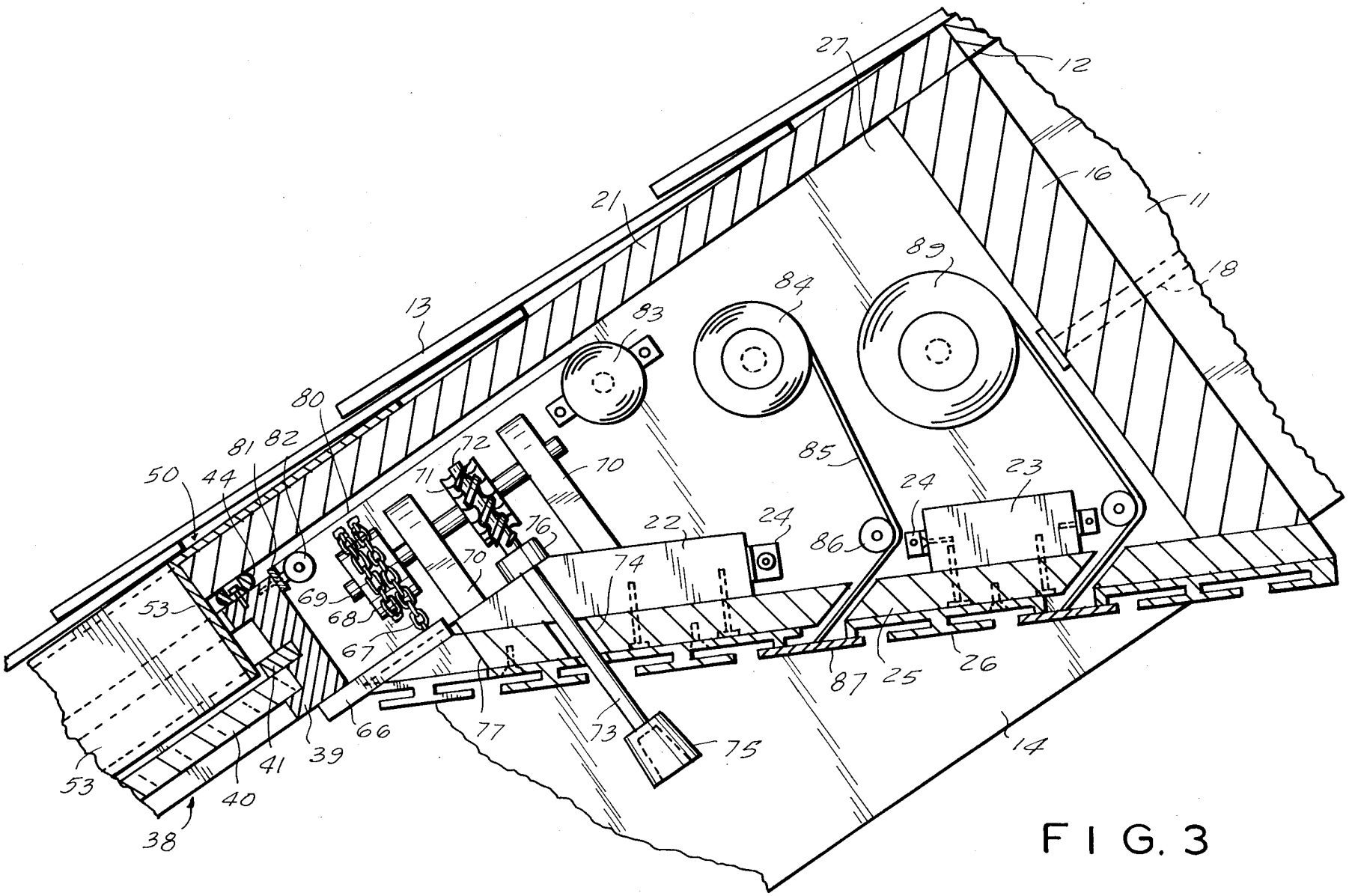
FIGS. 3 and 4 are fragmentary cross-sectional views, on an enlarged scale, of portions of FIG. 2.

The upper part of planar portion 52 of flashing member 50 overlies the lower portion of the outer face of panel 21 (FIGS. 2 and 3). Inwardly projecting portion 53 is sized to fit within the frame 39 of window 28 (see also FIG. 5), so that the inner edge of portion 53 is located closely adjacent to the outer face of window pane 40. The sides of planar portion 52 extend over narrow panels 45 (FIG. 5), and their lower regions extend over the sides of planar portion 59 (see FIGS. 1 and 6).

All the components described above may be assembled in advance, so that the entire unit is ready for installation. In new construction, the skylight assembly can be built in as the roof is fabricated. In an existing building, a rectangular opening of proper size is cut in the roof, and existing shingles removed from the margin of the opening. The skylight assembly described above is inserted into the opening and the frame members 14, 16, and 17 fastened to the rafters 10 and 11, as described above. Shingles are then secured over the flashing planar portions 52 and 59, and as shown in FIGS. 2 and 4 a shingle or shingles 13' are slipped beneath the lower part of flashing planar portion 59. If desired, shingles 63 (FIGS. 2 and 4) may be applied over the outer face of the lower part of flashing planar portion 59, and a line of roofing cement 64 may be inserted into the gap between panel 47 and shingles 63.

At the time of a rainfall, rainwater flows down the roof, and the water which flows toward the skylight is directed by flashing member 50, and the shingles over it, on to window pane 40. Splashing is trapped by flashing portion 53 and returned to the pane 40. Any water which finds its way between the inner end of flashing portion 53 and pane 40 is caught by the lateral sides 39*a* of window frame 39 and channeled down window pane 40. Seals 41 between pane 40 and frame 39 prevent leakage of the water inwardly of the window. When the water reaches the bottom of pane 40, it flows over the lower end 39*c* of the window frame. Since window frame portion 39*c* is flush with the window pane, no water can accummulate between the pane and frame portion 39*c*. Instead, all the water flows on to shingles 63, if they are present, or on to ramp portion 55 if they are not. The water is funneled by the ramp portion 55 and its side walls 56 to lower planar portion 59, from which it flows on to the shingles 13' below the skylight assembly.

Thus, it will be appreciated that there is no opportunity for water to leak through or around the skylight assembly even though no seals are employed, except for the usual glazing seal material 41. If desired, the planar portions 53 and 59 of the flashing members can be made wider so that they overlap roof boards 12 at the margin of the roof opening and thus bridge the seams between the skylight frame and the roof boards. This may help to insure against leaks through these seams. In addition, instead of making window frame portion 39*c* flush with the outer face of window pane 40, the window frame portion 39*c* could be sized so that the lower end of window pane 40 extends over portion 39*c*. This arrangement would also prevent accumulation of water at the lower end of the window.

The mechanism for opening and closing window 38 is located within chamber 27 (FIGS. 2 and 3). A tab-like extension 66 projects from the inner face of window frame 39 toward chamber 27, and one end of an elongated flexible element, such as a chain 67, is attached to extension 66. The remainder of the chain is wound around a bobbin 68 which is mounted on a shaft 69 rotatably held by supports 70 carried by beam 22. A worm wheel 71, fixed to the shaft between the supports, meshes with a worm 72 formed on the end of a vertical spindle 73 rotatably supported in a collar 76 carried by beam 22. The spindle extends inwardly through a hole 74 in oblique panel 25 and terminates in a manually operable handle 75. When handle 75 is rotated in one direction, the cooperating worm and worm gear cause rotation of shaft 69, whereby bobbin 68 rotates to unwind chain 67. As a result, window 38 pivots inwardly, on pins 43, under the influence of gravity, thereby opening the skylight. Extension 66 passes through a slot 77 in panel 25 and facade 26. The window can be opened to any desired degree until the total length of chain has been unwound from bobbin 68. It is important that in its maximum open condition, window 38 slopes toward ramp 55. In this way, should there be rain while the window is open, the water falling on to pane 40 will flow toward ramp 55 and on to the roof below the skylight. The maximum open position of window 38 could be provided by other means than the selected length of chain 68, such as by providing an abutment on one or both of the side members 14 to limit the opening movement of the window. By turning handle 75 in the opposite direction, chain 68 is wound upon bobbin 68 and the window is pivoted to its closed position.

If desired, various accessories can be provided with a skylight assembly according to this invention. For example, one end of a length of flexible window screen material 80 (FIGS. 2 and 3) is secured at 81 to window frame 39, the screen being about as wide as the window frame. Screening 90 passes over an idler roller 82, supported at its ends on frame side members 14, and is wound upon a supply roll 83, also supported at its end on side members 14, the supply roll functioning in the same manner as a window shade roll. As window 38 swings open, screen material 80 is pulled from supply roll 83 and over idler roller 82 and inwardly over the opening created by the open window. When the window is closed, the spring action within supply roll 83 causes the screen material to be rewound on the supply roll.

A similar window-shade-like supply roll 84 of tinted sheet plastic may also be housed within chamber 27. The tinted sheet 85 extends from roll 84 around an idler roller 86 and through a slot 88 in panel 25, its end being fixed to a handle 87 forming a simulated part of decorative facade 26. By pulling handle 87 to the left, in FIG. 2, tinted sheet 85 can be unwound from supply roll 84 and drawn across window 38 to filter out sunlight passing through the window. The handle 87 can be fitted into one of the slots of facade 34 to maintain the tinted sheet in its drawn out condition. When it is desired to remove the tinted sheet, it can be rewound on supply roll 84 in the manner of a window shade.

Supply roll 89 carries an opaque sheet material which can be used in the same manner as described above with respect to tinted material 85 in order to provide a "blackout" covering across skylight window 38. Another supply roll 90 is located in chamber 35, this roll carrying a product such as quilted sheet material, foam laminated material, or any other type of sheet material having thermal barrier qualities. This supply roll operates like the supply rolls 84 and 89, and permits a heat insulating material to be drawn across the skylight window. It will be appreciated that all the accessories described above, located within chambers 27 and 35, may be preassembled with the remainder of the skylight assembly prior to installation of the unit in a roof.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A skylight assembly for installation in an opening in the pitched roof of a building, comprising:

a main frame adapted to be secured within the roof opening, a window including a light-transmitting pane secured within a window frame, the window frame projecting outwardly of the pane at the top and both sides of the pane, means for mounting the window within the main frame for pivotal movement about one of the ends of the window between a closed position, in which the window is at an inclination generally conforming to the pitch of the roof, and an open position inwardly of the closed position, in which the window is located at an acute angle to the pitch of the roof, first means for directing water flowing down the roof on to the window, said first means including a flashing having a planar portion for arrangement in a plane parallel to the plane of the roof, and a portion projecting inwardly toward the window pane, said portion having a top wall and two side walls terminating inwardly of the outer surface of the top and side of the window frame so that their free edges are located within the confines of the window frame, and second means for directing water flowing down and off the window on to a portion of the roof below the main frame, said second means including a flashing member having a ramp portion flanked by outwardly projecting side walls, the upper end of the ramp portion receiving the lower end of the window including the window frame between its side walls, and the flashing member also having a planar portion for arrangement in a plane parallel to the plane of the roof.

2. A skylight assembly as defined in claim 1 wherein no part of the frame window extends outwardly of the outer surface of the pane at the bottom of the window, so that no water, which flows over the pane, accumulates between the bottom of the window frame and the pane.

3. A skylight assembly as defined in claim 1 wherein the outer edge of the bottom of the window frame is substantially flush with the outer surface of the window pane, so that no water, which flows over the pane, accumulates between the bottom of the window frame and the pane.

4. A skylight assembly as defined in claim 2 wherein the sides of the window frame project outwardly beyond the window pane, so as to direct all water flowing over the pane toward the bottom edge of the window.

5. A skylight assembly as defined in claim 1 wherein the flashing member is generally U-shaped, the open side of the U being the lowermost side of the flashing member.

6. A skylight assembly as defined in claim 1 wherein the ramp portion is arranged at an acute angle to the planar portion of the flashing member, and the two portions merge at the bottom of the ramp portion.

7. A skylight assembly as defined in claim 6 wherein the planar portion of the flashing is U-shaped and partially surrounds the ramp portion, the open side of the U being at the upper end of the ramp portion, and the side walls of the ramp portion interconnect the lateral edge of the ramp portion and the inside edges of the arms of the U-shaped planar portion.

8. A skylight assembly as defined in claim 1 wherein the ramp portion tapers in a downward direction.

9. A skylight assembly as defined in claim 1 wherein the window is so mounted within the main frame that no part of the window projects outwardly beyond the outer edge of the main frame.

10. A skylight assembly as defined in claim 1 wherein the controlling means includes an elongated flexible element connected to the window at one end and to a rotatable bobbin at the other end, and means for rotating the bobbin in opposite directions, to wind the flexible element on the bobbin or unwind it therefrom, so as to pivot the window in one direction or the other and hence close and open the window, respectively.

11. A skylight assembly as defined in claim 1 wherein the controlling means includes means for preventing the window from pivoting beyond a position wherein its end which is lower when the window is closed remains lower than the upper end of the window even when the window is fully open.

12. A skylight assembly as defined in claim 1 including a length of window screen material having a width about equal to that of the window, one end of the screen material being fastened to the upper end of the window, and the other end being be associated with a supply means from which the screen material is extendable and to which it can be withdrawn, whereby when the window is pivoted to open the skylight, the screen material is automatically drawn across the opening in the skylight.

13. A skylight assembly as defined in claim 1 including a length of shade material having a width about equal to that of the window, one end of the shade material being associated with a supply means from which the shade material is extendable and to which it can be withdrawn, the supply means being spaced from one end of the window, and means for drawing the shade material from the supply means across the window to a point beyond its other end.

14. A skylight assembly as defined in claim 1 and the main frame also carrying and inwardly facing prefinished panel adjacent to the window.

* * * * *